United States Patent [19]

Tarassoff

[11] Patent Number: 4,742,777

[45] Date of Patent: May 10, 1988

[54] DOUBLE MONO-CABLE AERIAL TRANSPORTATION SYSTEM

[75] Inventor: Serge Tarassoff, Seyssinet, France

[73] Assignee: Pomagalski SA, Fontaine, France

[21] Appl. No.: 816,148

[22] Filed: Jan. 3, 1986

[30] Foreign Application Priority Data

Jan. 4, 1985 [JP] Japan ..... 60-000023
Jan. 4, 1985 [JP] Japan ..... 60-000024

[51] Int. Cl.[4] ..... B61B 11/00; B61B 12/12

[52] U.S. Cl. ..... 104/173.2; 104/197; 104/202; 104/242

[58] Field of Search ..... 104/165, 173 R, 173 ST, 104/177-180, 192, 202-212, 215-217, 245, 247, 173.1, 115, 173.2, 87, 197, 242; 105/149.1

[56] References Cited

U.S. PATENT DOCUMENTS

| | | | |
|---|---|---|---|
| 1,719,758 | 7/1929 | Dotkiewicz | 104/180 |
| 3,037,464 | 6/1962 | Penney et al. | 104/209 |
| 3,274,954 | 9/1966 | Doppelmayer | 104/115 X |
| 3,394,661 | 7/1968 | Müller | 104/202 |
| 3,588,049 | 7/1971 | Nectouz | 254/147 |
| 3,743,278 | 7/1973 | Rixen | 104/173 R |
| 3,767,025 | 10/1973 | Louis | 104/209 |
| 3,871,303 | 3/1975 | Woodling | 104/205 |
| 4,100,822 | 7/1978 | Rosman | 104/173 ST |
| 4,220,095 | 9/1980 | Segafredo | 104/173.2 X |
| 4,226,187 | 10/1980 | Paulsen et al. | 104/173.2 X |
| 4,370,932 | 2/1983 | Etcheparre | 105/163 |
| 4,387,812 | 6/1983 | Biller et al. | 104/115 X |
| 4,473,011 | 9/1984 | Wuschek | 104/173 R |
| 4,509,430 | 4/1985 | Creissels | 104/173 R |

FOREIGN PATENT DOCUMENTS

| | | | |
|---|---|---|---|
| 0154819 | 1/1952 | Australia | 104/197 |
| 0056919 | 8/1982 | European Pat. Off. . | |
| 0093680 | 11/1983 | European Pat. Off. | 104/173 R |
| 2605683 | 7/1977 | Fed. Rep. of Germany | 104/192 |
| 2656340 | 6/1978 | Fed. Rep. of Germany | 104/173 R |
| 1249949 | 11/1960 | France . | |
| 1375792 | 9/1964 | France . | |
| 1453517 | 9/1966 | France . | |
| 1496897 | 10/1967 | France . | |

(Continued on next page.)

OTHER PUBLICATIONS

"The Telescaphe" by Creissels; from International Ropeway Review; 1/3/70.

*Primary Examiner*—Robert B. Reeves
*Assistant Examiner*—Scott H. Werny

[57] ABSTRACT

An aerial cable transportation system is disclosed that includes at least one vehicle supported on a carriage through a suspension with a plurality of clamps for disengageably securing the carriage to a pair of endless carrier and traction cables that are parallel to and alongside each other in a horizontal direction. The parallel cables are driven continuously at the same speed and supported by intermediate support and/or compression towers, each of which has a base, a shaft, a horizontal transverse cross arm, and two series of support and/or compression rollers for the cables. The clamps consist of two pairs of clamps, with each of the pairs of clamps being associated with one of the cables. The clamps define a rigid quadrilateral in the form of a parallelogram which is not a rectangle and which, in the engaged state, favors the synchronous passage of the two cables. The clamps each include a clamp body comprising a generally arch-shaped part mounted on the carriage with its concavity facing downwardly and extending outwardly from the carriage transversely from the direction of the movement thereof. The clamp body has an outer end defining a stationary jaw for the clamp and an inner portion and an elastically deformable member to secure the inner end portion of the arch-shaped part to the carriage while permitting a limited play of the arch-shaped part to the carriage on either side of a normal position about a transverse axis. The clamp body is pivotally mounted with respect to the carriage around a horizontal transverse pin by bearings fastened to the carriage. The stationary jaws include extensions extending in opposite directions along their associated cables but with the extensions being spaced from those on adjacent clamps to provide a clearance therebetween.

20 Claims, 8 Drawing Sheets

U.S. PATENT DOCUMENTS 2385614 10/1978 France .
2424838 11/1979 France .
2430901 8/1980 France .
2525981 6/1985 France .
410730 10/1966 Switzerland .
703891 2/1954 United Kingdom .
789190 1/1958 United Kingdom .
789901 6/1958 United Kingdom .
814998 6/1959 United Kingdom .
1126882 9/1968 United Kingdom .
1351132 4/1974 United Kingdom .
0658021 4/1979 U.S.S.R. ..... 104/173 R

DOUBLE MONO-CABLE AERIAL TRANSPORTATION SYSTEM

The invention concerns an aerial cable transportation system of the type comprising one or more spaced vehicles which are rigidly but disengageably associated with each other by clamping clamps borne by a carriage which is associated with a suspension, having two endless cables, namely a carrier cable and a traction cable which are parallel to each other and located one alongside of the other in the horizontal direction and which are driven in continuous travel at the same speed and are supported by intermediate towers.

Systems of this type are already known which comprise, in particular, a carriage bearing two pairs of disengageable clamps, namely two clamps for each cable, the four clamps constituting a rigid quadrilateral connection between the two cables, which necessarily move in synchronism. There is also known a clamping clamp which comprises a clamp body associated rigidly with the chassis of the carriage, a stationary jaw borne by the clamp body, a movable jaw borne by an arm articulated to the clamp body; resilient means for the return of the movable jaw towards the stationary jaw such as a substantially vertically arranged spring; and a disengagement roller for the clamp, which roller is mounted for free pivoting on the arm around a substantially horizontal, transverse axis and is capable of cooperating with a clutch-engagement ramp which is part of the clutch disengagement and engagement means present at each end station. Aerial cable transportation systems are also known in which each cable, both carrier and traction, passes at the location of a tower over a rocker which may have support rollers or compression rollers, the towers then being referred to as support towers or compression towers respectively. These towers comprise a base, a shaft which is vertical or extends upward, a horizontal bracket which is transverse to the path of the cables and two sets of cable support or compression rollers.

Such systems have the advantage that extensive turnaround of the vehicles is possible (hence a large flow of passengers or materials). Furthermore, the connection between the two cables defines a rigid quadrilateral formed by the clamps of the vehicles, which results in a synchronous drive avoiding any integration of shifting and inclining of the vehicles.

However, these known two-cable systems have the drawback that they are of a heavy and bulky structure resulting generally from the simple juxtaposition of two structures of the kind known and used in the case of a mono-cable installation. For this reason, these systems do not have any of those characteristics of comfort and safety which are necessary. In particular, the rigid quadrilateral formed by the clamps of the vehicles is generally in the form of a trapezoid. This trapezoidal shape not being perfectly symmetrical, the vehicle is not perfectly balanced. Furthermore, the inevitable space taken up in axial direction is a source of problems upon passing the towers, and more particularly the cable travel rollers or else in the more curved sections of the cable paths. Furthermore, the construction of transportation systems of the two aerial cable type with cabins which may be of large capacity requires that the towers be designed so as to permit the passage of the cabin-bearing carriage and maintain the cables in a constant relative position and, finally, so as closely to follow the generally curved shape of the path of the cables above the tower.

The present invention is therefore directed at remedying these drawbacks, and for this purpose it proposes an installation of the above-mentioned type with two cables, in which each vehicle carriage comprises two pairs of clamps, each of the pairs of clamps being associated with one of the two cables, these two pairs of clamps defining a rigid quadrilateral in the form of a parallelogram which, in the engaged state of the clutch, favors the synchronous displacement of the two cables; each carriage has support rollers mounted for free pivoting around horizontal or transverse axes and guide rollers mounted for free pivoting around vertical axes permitting the supporting of the carriage and the guiding of it in transverse direction respectively when the clamping clamps are disengaged at the end stations; the two pairs of clamps are transversely spaced apart by the minimum distance possible in view of the space taken up by the clamps themselves, and the two central clamps are spaced axially from each other by a distance at least equal to the space taken up by the suspension; disengagement rollers of the two pairs of clamps are located in the immediate vicinity of the axial vertical plane of symmetry and these rollers rest on a single engagement-disengagement ramp; each clamp body is associated with the chassis of the carriage by elastically deformable members and the stationary jaws of the clamps are extended by points, the inner points of each pair of clamps being disengaged from each other so as to permit individually a slight movement of the clamps to both sides of their normal position while assuring the general holding in position of these clamps; each carriage has two pairs of comfort rollers which pivot freely around horizontal, transverse axes and are adapted to roll on travel tracks associated with each of the intermediate support and/or compression towers; these travel tracks generally follow the travel profile of the cables while being very slightly spaced from said profile vertically so that upon passing over a tower the carriage, due to these comfort rollers, rolls on the travel track, the cable being very slightly shifted from the grooves of the pulleys whether the latter are of the support type or of the compression type; each intermediate support and/or compression tower has means for preventing the cables from escaping from the grooves of the corresponding rollers; each intermediate support and/or compression tower has means for recovering the cables should they escape the grooves of the corresponding support rollers.

As a variant, the quadrilateral defined by the two pairs of clamps is of rectangular shape.

In accordance with one preferred embodiment of the invention, the means for preventing the cables from escaping from the corresponding rollers consist of an inwardly protruding curved plate which has its convexity facing the inside and is located immediately above the groove of the adjacent rollers; the cable recovery means consist of a gutter section which leaves a free space for the passage of the suspension and the carriage and which are curved with their convexity facing upward if the corresponding intermediate tower is a support tower and with their convexity facing downward if the corresponding intermediate tower is a compression tower.

These characteristics lead to structures of minimum weight and size, while assuring good distribution of the forces and a comfort and safety which are greatly improved as compared with the known aerial cable transportation systems.

The other characteristics of the invention will become evident from the following description, read with reference to the accompanying drawings, in which.

Figure 1:
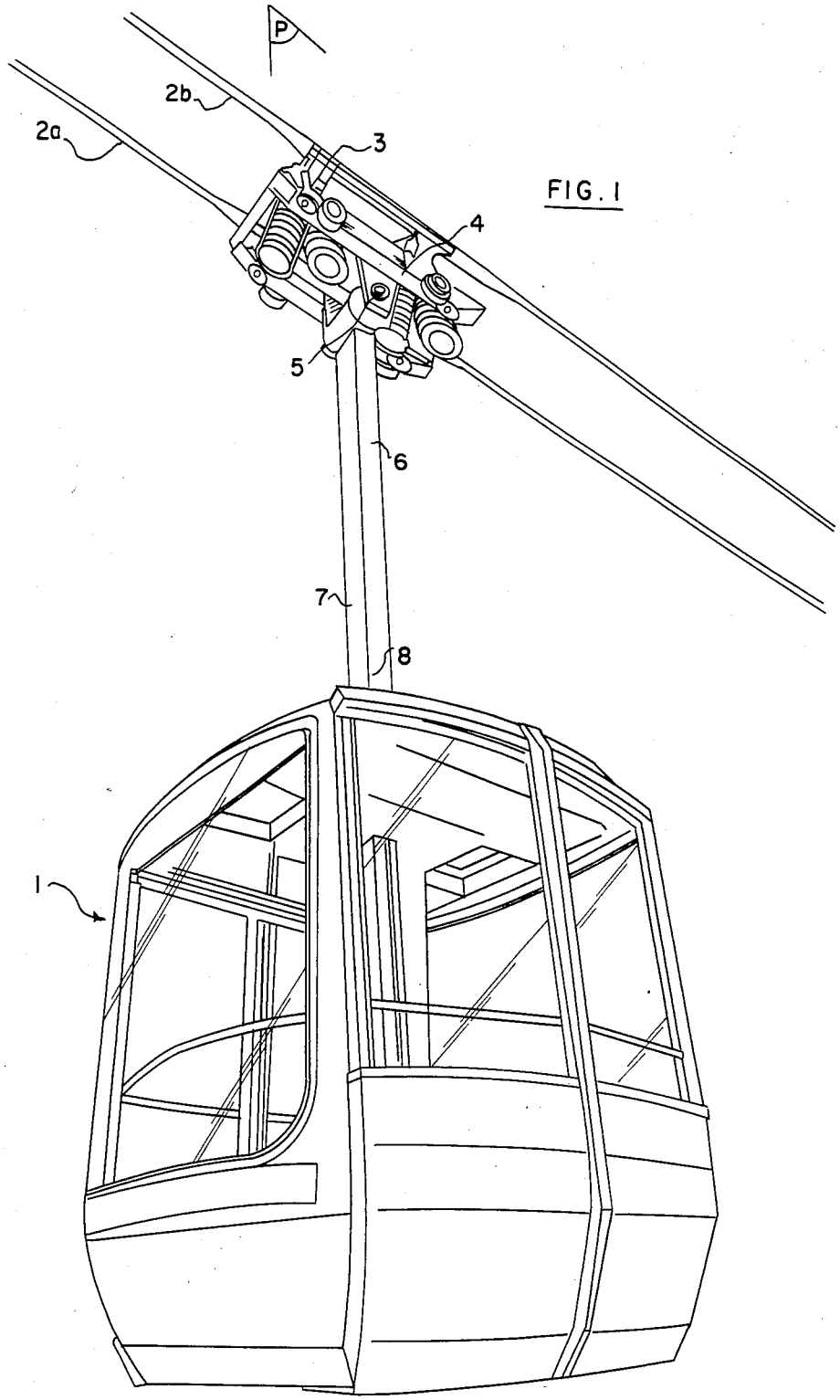
FIG. 1 is a perspective view of a vehicle such as a cabin and of two associated carrier and traction cables of a system in accordance with the invention.

The invention concerns an aerial cable transportation system of the type comprising one or generally several vehicles 1 which are spaced (individually or in groups) along two cables 2*a*, 2*b* with which they are rigidly but disengageably associated by clamping clamps 3.

The clamping clamps 3 are borne by a carriage 4—described in greater detail below—to which there is articulated, around a horizontal, transverse shaft 5 the upper end part 6 of a vertical suspension 7 which is attached rigidly at its lower end part 8 to the chassis of the vehicle 1.

Figure 2:
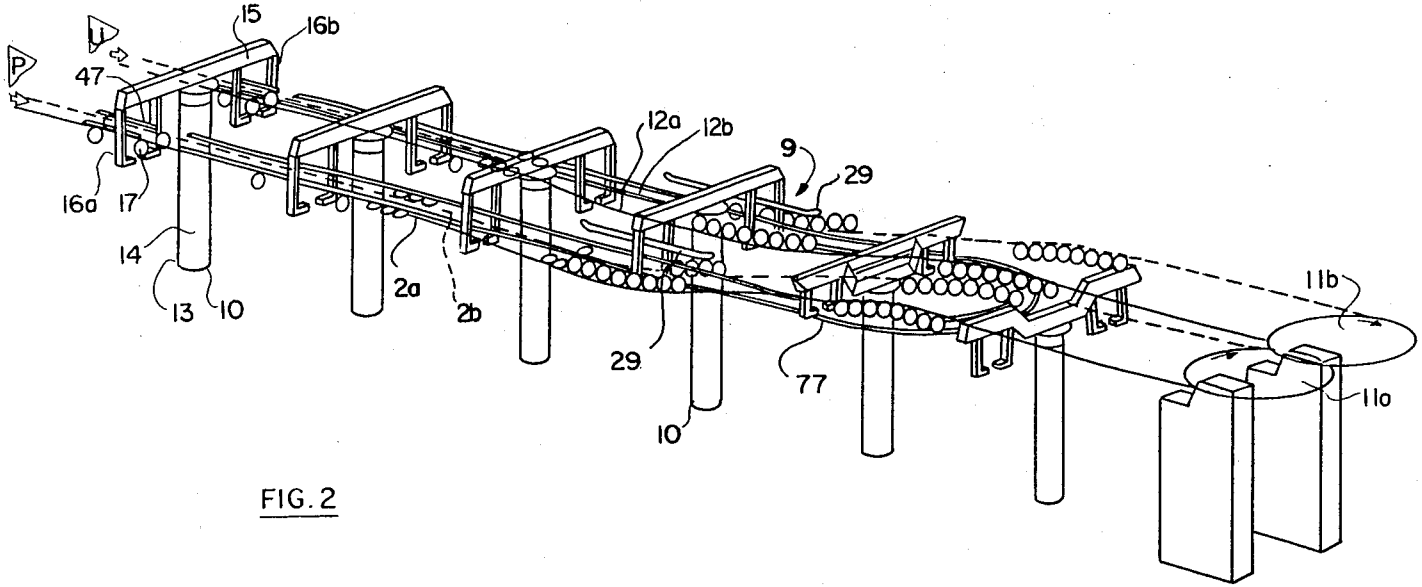
FIG. 2 is a diagrammatic view in perspective at the right of an end station and at the left of intermediate towers of the installation, in the present case of the support type, which may be at a greater or lesser distance from said station.

The cables 2*a*, 2*b*—which do not in themselves form part of the invention—are endless, separate carrier and traction cables, parallel to each other, located one alongside the other in horizontal direction, and driven with continuous travel at the same speed. They extend between two end stations, such as the end station 9 shown in FIG. 2, for the loading and unloading of the vehicles 1 and they are supported inbetween by one or more towers 10 which will be described in further detail below.

The vehicle 1 shown in FIG. 1 is a cabin intended for the transportation of passengers. However, the vehicle 1 may also be a bucket or the like for the transportation of materials. In the example shown, the vehicle 1 has, in known manner, in addition to its chassis, a body, movable doors, windows and all of the customary equipment (bumpers, exit trap doors, etc.).

Each end station 9, which does not in itself form part of the invention, comprises two driving wheels 11*a*, 11*b* which drive the two cables 2*a*, 2*b* (in the case of FIG. 2, the axes of the two wheels 11*a*, 11*b* are vertical; however, these axes may be inclined in any way); fixed means for the support of the vehicles 1 such as a rail located substantially horizontally and having a generally U shape surrounding the drive wheels, not shown; downstream means for the disengagement of the clamps, making it possible to disconnect a vehicle 1 from the cables 2*a*, 2*b* so as to park it on stationary support means, not shown; downstream means for the engagement of the clamps, making it possible to associate a vehicle 1 parked on the fixed support means with the cables 2*a*, 2*b*, not shown; drive means for driving the drive wheels 11*a*, 11*b* at the same speed, not shown; means for tensioning the cables 2*a*, 2*b*, not shown; means for entrance into the vehicles 1, such as platforms, permitting the passengers, for instance in the case of a cabin, to enter and depart from the cabins when the latter are on the stationary support means at standstill or low speed, not shown; possible means for the opening and closing of the doors of the vehicles, not shown; means for driving the vehicles independently of the cables when they are present on the fixed support means, this so as to cause them to pass from a first pair of cables 2*a*, 2*b* to a second pair of cables 12*a*, 12*b* (which may be the same, as explained further below).

Upstream and downstream refer to the direction of travel of the vehicles 1 along the cables 2*a*, 2*b*.

An intermediate tower 10 is intended to support the two cables 2*a*, 2*b* which are associated with the (ascending or descending) vehicles 1 and, preferably, the two pairs of cables 2*a*, 2*b*, 12*a*, 12*b* of the ascending and descending vehicles, which two cables may result from two cables 2*a*, 12*a* on the one hand and 2*b*, 12*b* on the other hand which are endless and spaced transversely from each other. However, the tower 10 may be designed to support only two cables 2*a*, 2*b* of an ascending or descending cabin. Such a tower 10 comprises, in known manner, a base 13 anchored to the ground; a shaft 14 which is vertical or directed upwards and is rigidly associated with the base 13; a cross arm 15 which is fastened rigidly to the upper end part of the shaft 14 and has a general horizontal direction transverse to the cables 2*a*, 2*b*, 12*a*, 12*b*; two yokes 16*a*, 16*b* having generally the shape of an inverted U, which are arranged vertically, transversely and co-planarly at the two opposite free end parts of the cross member 15; two pairs of rockers extending in the horizontal direction or substantially horizontal, the two rockers of each pair being spaced transversely apart from and facing each other and they being associated with the descending vertical arms of a yoke 16*a*, 16*b*; and finally rollers 17 borne by the rockers and within the grooves of which the cables 2*a*, 2*b*, 12*a*, 12*b* pass.

Figure 6:
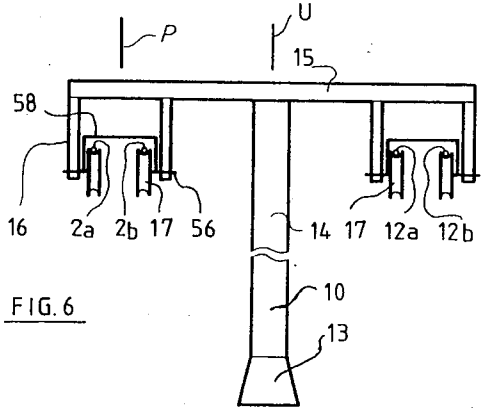
FIG. 6 is a diagrammatic view in elevation of a tower for an aerial cable transportation system in accordance with the invention, this tower being of the support type.
Figure 8:
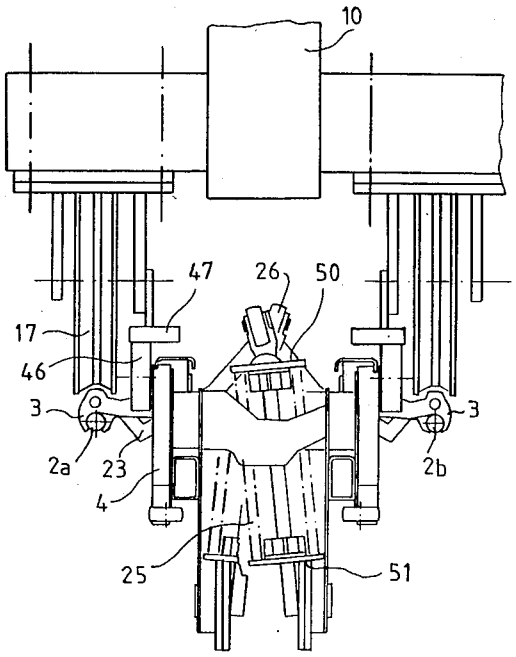
FIG. 8 is a diagrammatic end view showing the support carriage of a vehicle above an intermediate compression tower of an installation in accordance with the invention.
Figure 9:
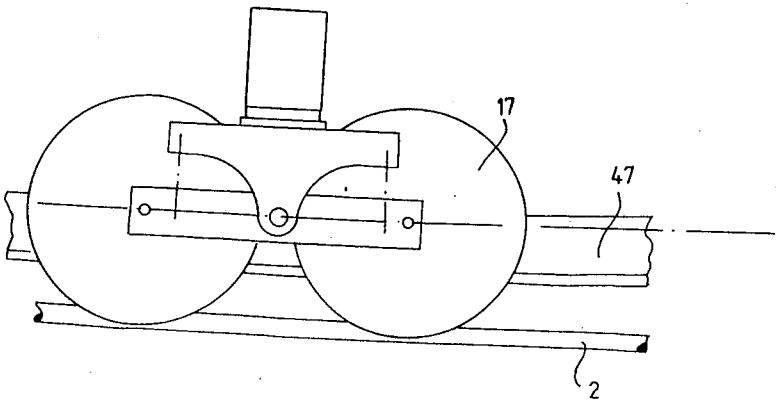
FIG. 9 is a diagrammatic side view of the compression tower shown in FIG. 8.

These rollers 17—and therefore the towers 10 which support them—are of two possible types, namely support or compression, depending on whether they support the cables 2*a*, 2*b*, 12*a*, 12*b* from below (FIGS. 2, 6, 7) or, on the other hand, rest against these cables 2*a*, 2*b*, 12*a*, 12*b* from above (FIGS. 8 and 9), this so that the cables 2*a*, 2*b*, 12*a*, 12*b* follow the desired path, with due consideration of the unevennesses of the ground, while being held and guided.

The cables 2*a*, 2*b*, 12*a*, 12*b* are generally inclined, one of the end stations being located at a lower level (downstream station for cables 2*a*, 2*b*) and the other station being located at a higher level (upstream station for cables 2*a*, 2*b*). Therefore in the text the words "horizontal" and "vertical" are relative and refer either to the customary physical concept or, relatively, on the one hand, to the trace of the plane of the cables 2*a*, 2*b*, 12*a*, 12*b* with respect to a vertical plane perpendicular to said plane and parallel to the cables and, on the other hand, to a straight line perpendicular to the plane of the cables. By convention, the directions "axial" and "transverse" are understood as parallel to the axes of the cables 2a, 2b, 12a, 12b and horizontally perpendicular to the cables 2a, 2b, 12a, 12b respectively. It is understood that, without exception, the directions horizontal, vertical, axial and transverse also cover in general those directions which are close to them.

The assembly comprising two cables 2a, 2b or 12a, 12b of the same vehicle 1, said vehicle 1, its suspension 7, its carriage 4, the corresponding yoke 16a or 16b of an intermediate tower 10 and its two rockers present an axial vertical plane of symmetry P equidistant from the two cables in question 2a, 2b or 12a, 12b. Furthermore, an intermediate tower 10, if it supports two pairs of cables, has an axial vertical plane of symmetry U passing through its base 13 and shaft 14.

Accordingly, the installation is described for each element which composes it, considered individually, it being understood that it is present again by symmetry, unless otherwise indicated.

In the following description, reference is had to the part of the intermediate tower 10 intended for the two cables 2a, 2b. Similarly, in the following description reference is had to a vehicle 1 associated with the cables 2a, 2b. The elements associated with—or on the side of—cable 2a have reference numbers followed by the subscript a and the elements associated with—or on the side of—cable 2b have reference numbers followed by the subscript b.

A clamp 3 comprises a clamp body 18 associated with the chassis 19 of the carriage 4; a stationary jaw 20 borne by the clamp body 18, consisting in particular of two parts 20a, 20b which are spaced axially apart; a movable jaw 21 placed between the two parts 20a, 20b of the stationary jaw and borne by the outer, lower free end part 22 of a lever-forming arm 23 located in a transverse plane, having the general "L" shape, articulated to the clamp body 18 around an axial shaft 24; resilient means 25 for returning the movable jaw 21 towards the stationary jaw 20 (corresponding to the engaged state), such as a spring arranged substantially vertically, and a disengagement roller 26 for the clamp 3, mounted in freely pivoting manner at the inner, upper free end part 27 of the arm 23 around the substantially horizontal, transverse shaft 28 and adapted to cooperate with the upstream disengagement and downstream engagement means which assume the shape of an inclined ramp 29.

The carriage 4 comprises a pair of clamps 3'a, 3''a associated with the cable 2a and a pair of clamps 3'b, 3''b, associated with the cable 2b. The chassis 19 of the carriage 4 being rigid and the clamps 3 being also rigidly associated with it, seen from above, that is to say in plan view, and subject to what is stated below with regard to the resilient means for connecting the clamp body 18 to the chassis 19, the two pairs of clamps 3'a, 3''a, 3'b, 3''b define a "rigid" quadrilateral in the form of a parallelogram which, in engaged state, favors the synchronous displacement of the two cables 2a, 2b. Thus the clamps of the two pairs of clamps are also spaced apart from each other in axial direction, for instance by a distance D of about 800 mm. This arrangement makes it possible to increase the compactness of the carriage 4 and therefore also its weight and to limit the distance between the two cables 2a, 2b, which may be on the order of 750 mm.

In a variant which is not shown in the drawing, the quadrilateral has the shape of a rectangle.

According to the invention, the two end clamps 3'a, 3'b, on the one hand, and 3''a, 3''b, on the other other, are immediately adjacent each other in axial direction, which assures the carriage 4 the minimum dimensions possible in axial direction. Accordingly, two end clamps are spaced axially from each other by a distance corresponding substantially to the axial length of a clamp 3, for instance on the order of 300 mm.

The two central clamps which belong to the two distinct pairs of clamps, namely 3'a and 3''b, are spaced axially from each other by a distance at least equal to the axial size of the suspension 7. For example, the distance between the two transverse axes of the two central clamps 3'a, 3''b is on the order of 500 mm.

According to the invention, the two pairs of clamps 3'a, 3''a, on the one hand, and 3'b, 3''b, on the other hand, are spaced apart transversely by the minimum distance possible with due consideration of the size of the clamps. Furthermore, the clamps 3 protrude transversely towards the outside of the carriage 4, which is entirely located between the two cables 2a, 2b.

The carriage 4 comprises primarily two axial side rails 30a, 30b and cross members, in particular end cross members 31. These longitudinal members 30a, 30b can be spaced transversely apart from each other by about 450 mm. As to the two end cross members which define the maximum size of the carriage 4, they can be spaced apart from each other by a distance of about 1600 mm.

The arrangement which has just been described is such that the clamps 3'a, 3''a, 3'b, 3''b extend practically between the two side rails 30a, 30b in addition to their protruding part formed by the stationary jaw 20 and the movable jaw 21. Furthermore, the resilient means 25, as well as the disengagement rollers 26, are located in the immediate vicinity of the axial vertical plane of symmetry P. For example, the travel paths of the disengagement rollers 26 of the two pairs of clamps 3'a, 3''a, 3'b, 3''b are spaced from each other in engaged state by about 60 mm.

It follows that, in accordance with one characteristic of the invention, the installation comprises a single engagement-disengagement ramp 29 at each end of each pair of cables 2a, 2b or 12a, 12b, that is to say a single ramp on each side of each end station 9 onto which ramp the disengagement rollers 26 of the two pairs of clamps 2'a, 3''a, 3'b, 3''b come to rest.

According to the invention, a clamp body 18 is associated with the chassis 19 of the carriage 4, in particular with the side rails 30a, 30b, by elastically deformable members 32 such as blocks of rubber or elastomer. These members 32 have the purpose of assuring the general holding of the clamp 3 with respect to the chassis 19, with however the possibility of small limited clearance on either side of its normal position of rest around its transverse axis of symmetry defined by shaft 33. This clearance is, for instance, on the order of 2°. This arrangement permits the clamps to follow without excess force the curved shape of the path of the cable 2a, 2b. Of course, the members 32 are only slightly deformable and are only under the effect of a force sufficient for the clamp body 18 to be normally held without being able to pivot in untimely manner around the axis of symmetry defined by the shaft 33.

In order that this function present the best efficiency, a clamp body 18 preferably comprises a part 34 which extends axially and in a vertical plane and has the general shape of an arch with its concavity facing downward. This part 34 protrudes towards the outside horizontally and transversely in order to constitute the fixed jaw 20. These two lower free end parts 35 are associated with the chassis 19 and, in particular, to the side rails 30*a*, 30*b* by the elastically deformable member 32.

In order to permit the clearance of the clamps due to these elastically deformable members 32, the two parts 20*a*, 20*b* of a stationary jaw are extended axially by points 36 which cooperate with the cables 2*a*, 2*b*; the inner points of the two clamps of each pair of clamps 3'*a*, 3''*a* on the one hand and 3'*b*, 3''*b* on the other hand are separate and are not rigidly associated to each other.

Figure 4:
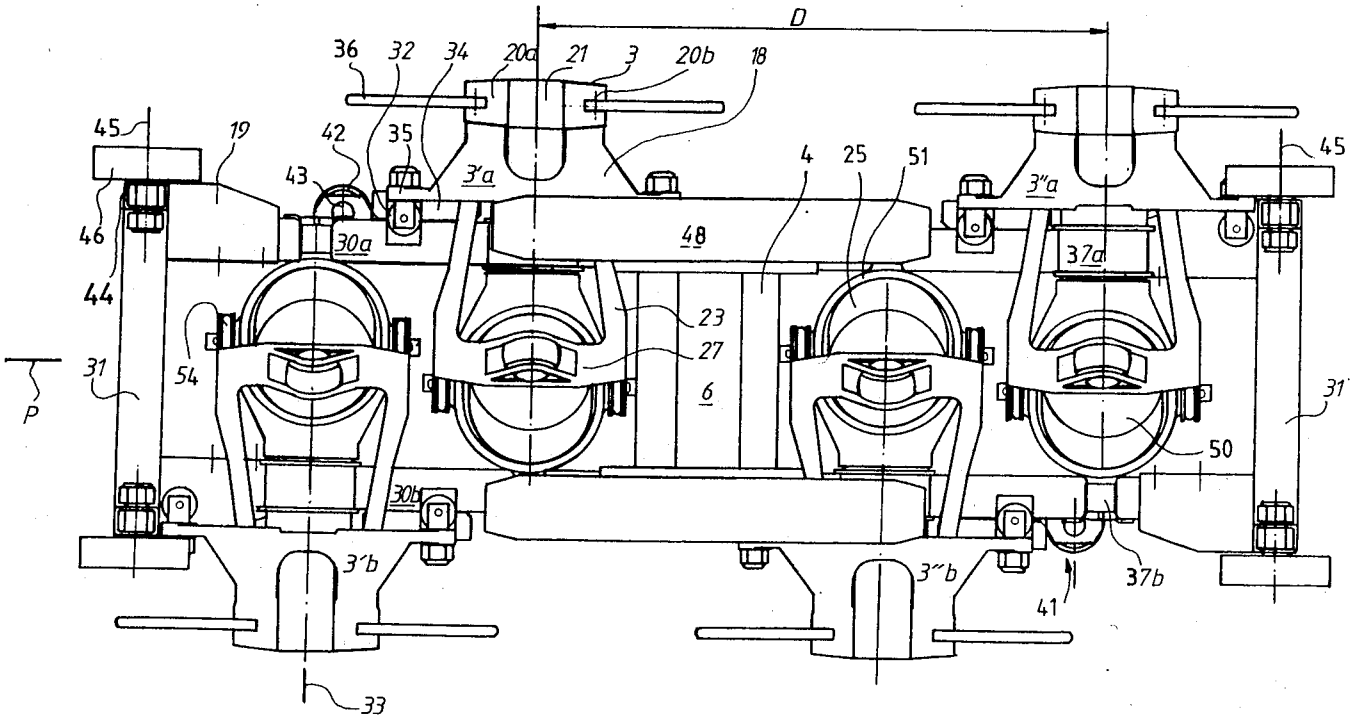

Furthermore, as can be noted from FIG. 4, the end clamps 3'*a*, 3'*b* on the one hand, and 3''*a*, 3''*b* on the other hand are imbricated in one another. Thus, the centermost elastically deformable member 32 of an end clamp such as 3''*a* is located in the transverse direction between the two elastically deformable members 32 of the adjacent clamp 3''*b*.

Figure 5:
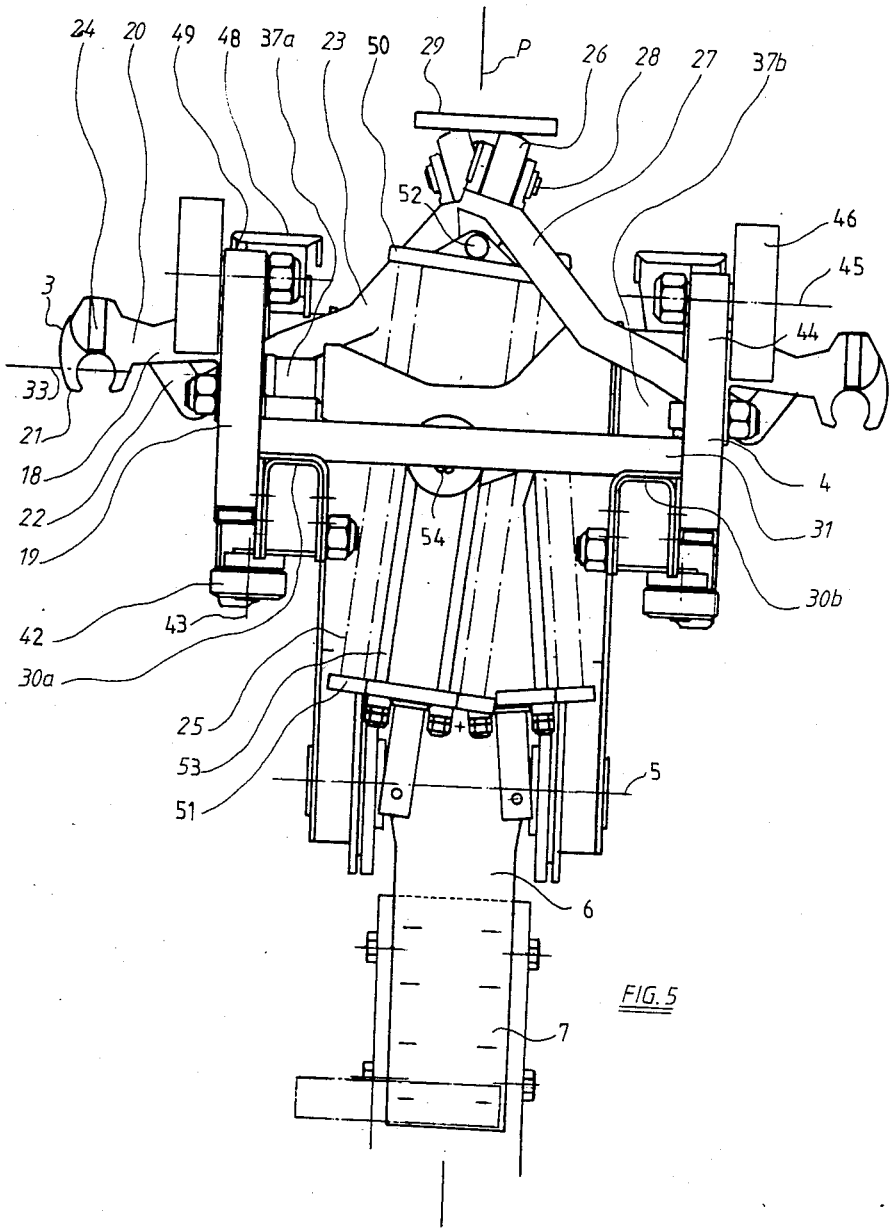

In order to permit the best mounting of the clamp 3, the clamp body 18 is mounted for pivoting around its transverse shaft 33 in bearings 37*a*, 37*b* which are fastened to the side rails 30*a*, 30*b* on their inner face (FIG. 5).

According to the invention, the carriage 4 has support means 38, in particular support rollers 39, mounted for free pivoting around horizontal and transverse shafts 40 and guide means 41, in particular guide rollers 42, mounted for free pivoting around vertical shafts 43, which make it possible to support the carriage 4 and guide it in transverse direction respectively when the clamping clamps 3 are disengaged in the end stations 9.

Each of the end cross members 31 has at each of its free ends a lug 44 which is located in an axial vertical plane and to the end part of which there is mounted, for free rotation around a transverse horizontal shaft 45, a comfort roller 46 intended to roll on a travel track 47 associated with an intermediate tower 10.

Figure 3:
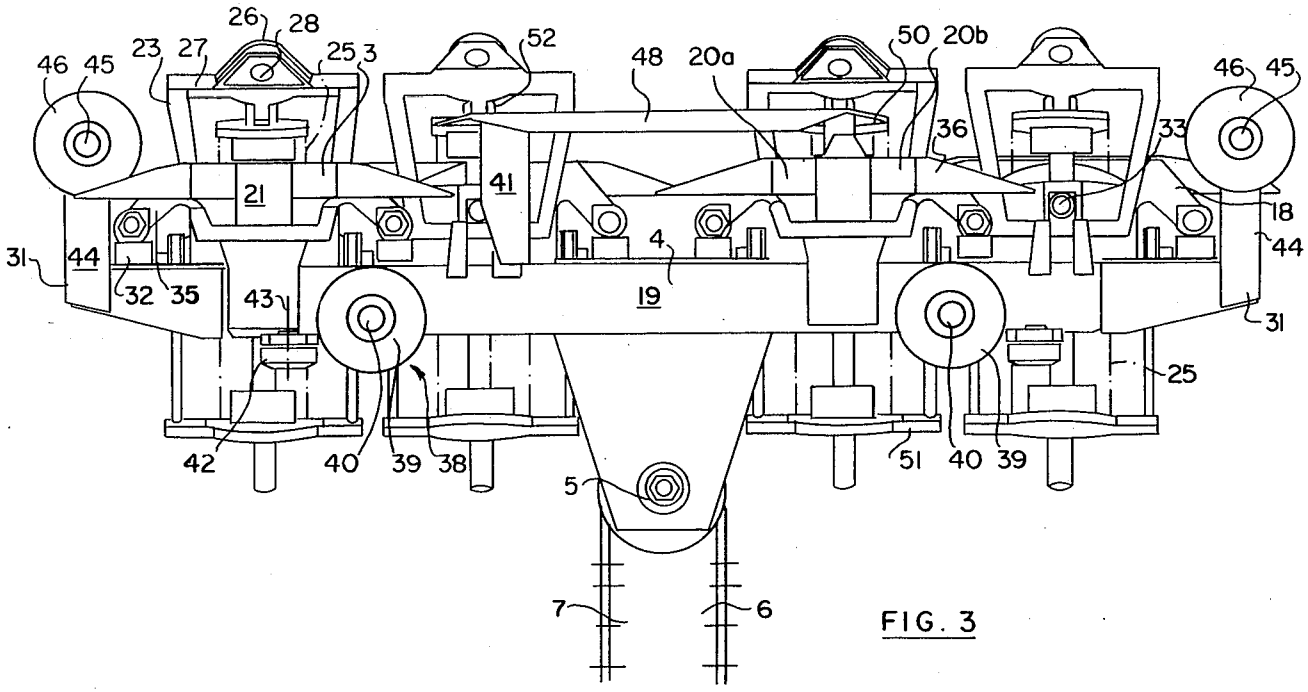
FIGS. 3, 4 and 5 are three diagrammatic views, namely an elevation, top view and end view respectively, of the support carriage of a vehicle of a system according to the invention.

In FIG. 3 there are shown the comfort rollers 46 of a carriage 4, the rollers being placed at the ends of the latter in axial direction, intended to roll on a travel track 47 associated with an intermediate tower 10 of the compression type. In this case, the lug 44 is directed upwards. However, other rollers mounted for free pivoting around a horizontal, transverse shaft at the end part of the lugg 44 or of another lug, which are directed towards the bottom of the carriage 4 and, for instance, at its ends cooperate, on their part, with the travel tracks of an intermediate tower of the support type, as shown in the left-hand part of FIG. 2.

An intermediate tower 10 comprises two travel tracks 47 for the comfort rollers 46, following generally the profile of travel of the cables 2*a*, 2*b*, as defined by the rollers 17, while being very slightly more curved than this theoretical travel profile of the cables so as to be spaced from it vertically upward or downward depending on whether there is concerned a tower with support rollers (left-hand part of FIG. 2) or with compression rollers (FIGS. 8 and 9) except at its end. Spaced upward or downward does not mean the relative overall position of the tracks 47 with respect to the rollers 17 but the relative variation in spacing between them. On the other hand, the track 47 can be placed, as a whole, above or below the rollers 17, depending on the configuration. Thus, in the case of the compression rollers shown in FIGS. 8 and 9, the tracks 47 are placed alongside of the lower part of the rollers 17. As a result of this arrangement, upon passing over a tower the carriage rolls by means of its comfort rollers 46 on travel tracks 47 which are respectively above and below the latter, depending on whether the tower is of the support or compression type, while being driven by the cables 2*a*, 2*b* which are very slightly spaced from the grooves of the rollers 17. This function is all the better satisfied when the comfort rollers 46 are spaced axially from each other by the greatest distance possible.

According to the invention, in the engaged state of the clamp (FIG. 3), the clamp body 18 rests on the upper part of the corresponding cable 2*a*, 2*b*. The stationary and movable jaws 20, 21 are applied against the inner and outer lateral parts of the cable. It results from this that the lower part of the cable 2*a*, 2*b* remains substantially free. This arrangement assures a good application of the carriage 4 on the cables 2*a*, 2*b* while permitting smooth passage of the rollers 17 over the towers, particularly when they do not have a travel track 47.

A carriage 4 also has two axially extending friction bands 48 which are placed horizontally in the same plane and space apart transversely from each other above the central portion of the side rails 30*a*, 30*b* with which they are rigidly associated by vertical lugs 49. These friction bands 48 are intended to be functionally operative in each end station 9 either to slow down the carriage 4 which has been disconnected from the cables 2*a*, 2*b* or, on the other hand, to drive this carriage before it is coupled with the cables 2*a*, 2*b*.

The resilient means 25, such as a coil spring, are mounted between an upper cup 50 and a lower cup 51. The upper cup 50 is associated with the free end portion 27 of the arm 23 around a horizontal, axial articulation shaft 52. The lower cup 51 is fastened to the end portion of a yoke 53 which is arranged substantially vertically, associated at its upper end part with the clamp body 18 around a horizontal, axial shaf 54 located substantially in the axial vertical plane of symmetry P.

A tower of an installation in accordance with the invention is described below with reference to the case of a support roller tower, but it is clear that this description can obviously be adapted to the case of a compression roller tower.

The tower 10 of the invention comprises two support rockers 55*a*, 55*b* which are symmetrical with respect to the plane P and are articulated at their central part for free pivoting around a horizontal, transverse shaft 56 to a vertically and transversely placed yoke 16 placed which is rigidly associated with the cross bar 15. This yoke, which has in general the shape of an inverted U, comprises a web, not shown, rigidly associated with the cross bar 15 or, as a variant, has no web, the latter forming an integral part of the cross bar 15 and constituting its free end portion, and two flanges 57*a*, 57*b* which are symmetrical with respect to the plane P and directed vertically downward, at the lower free end portion of which the shaft 56 is located.

The rockers 55*a*, 55*b* are associated for free pivoting on the inner faces of the flanges 57*a*, 57*b* around the shaft 56 by two trunions 56*a*, 56*b*, leaving the space between the two support rockers 55*a*, 55*b* free.

Preferably, the two support rockers 55*a*, 55*b* are linear and formed of a profiled metal part having a square or rectangular cross section.

The same is true of the flanges 57*a*, 57*b* and of the cross bar 15.

Figure 7:
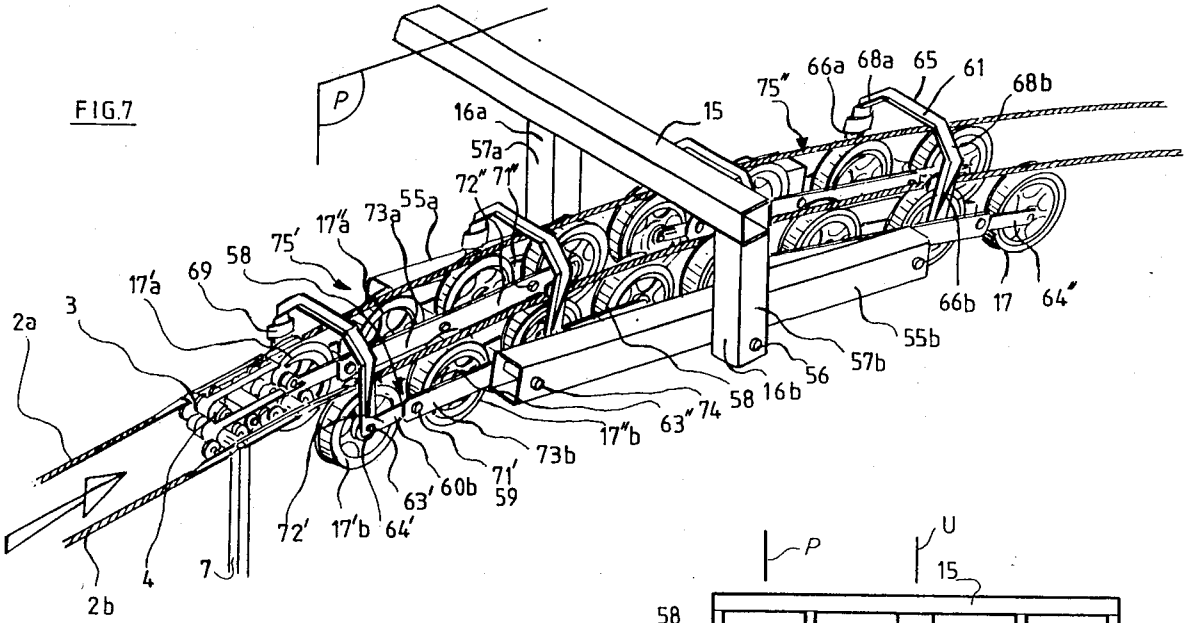
FIG. 7 is a partial diagrammatic view in cross section, showing the tower shown in FIG. 6.

The tower 10 furthermore comprises a plurality of unit rockers 58 having rollers 17 articulated for free pivoting directly or indirectly on the support rockers 55*a*, 55*b* around horizontal and transverse shafts 59. These unit rockers 58 are placed one behind and in the vicinity of each other over the necessary length, with due consideration of the support forces exerted by the cables 2a, 2b and the more or less curved course of the cable path. One typical and preferred embodiment is shown in FIG. 7 in which four unit rockers 58 are provided.

Figure 10:
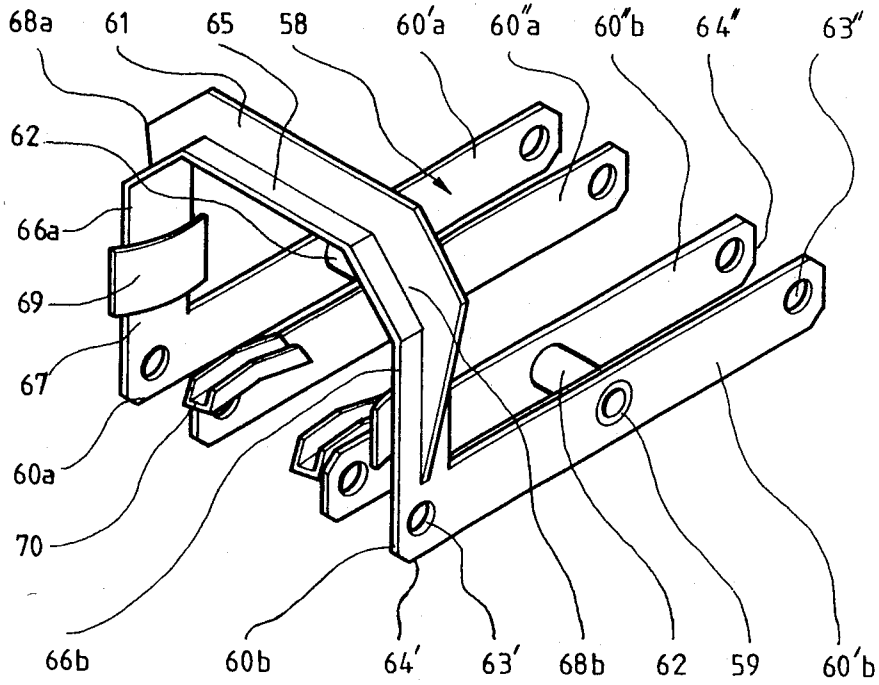
FIG. 10 is a partial view, in perspective, showing a single rocker of the tower of a system in accordance with the invention.

A unit rocker such as 58 will now be described, with reference more particularly to FIG. 10.

The unit rocker 58 comprises, on the one hand, two side rails 60a, 60b for the support of the rollers 17a, 17b which are transversely spaced from each other and symmetrical with respect to the plane P and, on the other hand, a rigidifying arch 61 rigidly connecting the two side rails 60a, 60b to each other.

Each side rail 60a, 60b preferably comprises two parts which are transversely spaced from but rigidly fastened to each other, namely in the case of the side rail 60a the two parts 60'a and 60''a and in the case of the side rail 60b the parts 60'b and 60''b. Between each pair of parts 60'a, 60''a, 60'b, 60''b there are mounted for free rotation the support rollers 17a, 17b.

The two parts 60'a, 60''a, 60'b, 60''b of a side rail 60a, 60b are rigidly associated with each other by a central cross brace 62.

A unit rocker 58 has two upstream rollers 17'a, 17'b and two downstream rollers 17''a, 17''b, the upstream rollers 17'a, 17'b on the one hand, and the downstream rollers 17''a, 17''b on the other hand, having coaxial pivot shafts 63' (upstream shaft) and 63'' (downstream shaft) respectively. Of course, each of the shafts 63', 63'' is in two parts so as to leave the center space between the rollers free in order to permit the passage of the carriage 4 and of the suspension 7.

Preferably, the two shafts 63', 63'' are provided at the two free end portions 64', 64'' of the side rails 60a, 60b.

The rigidifying arch 61 preferably connects the two side rail parts 60a, 60b which are located towards the outside, namely 60'a and 60'b. This rigidifying arch is located vertically and transversely and has, in general, the shape of an inverted U comprising a central horizontal, transverse web 65 and two side flanges 66a, 66b which are vertical and directed downward, associated rigidly at their lower free end part 67 with the side rails 60a, 60b in particular at the outer parts 60'a, 60'b.

Preferably, the rigidifying arch 61 has, in transverse cross section, the shape of a T so as to assure its non-deformability. The web 65 is also preferably connected to the flanges 66a, 66b by cut flats 68a, 68b.

A unit rocker 58 preferably has a single rigidifying arch 61 placed at one of the free parts of the side rail 60a, 60b and preferably on the side of the free end portion 64', for instance upstream.

In elevation (that is to say, seen from the side), a unit rocker 58 therefore has a generally L shape the horizontal branch of which consists of the side rails 60a, 60b and the vertical branch of which is formed by the rigidifying arch 61.

A tower such as has just been described preferably comprises means 69 to prevent the cables 2a, 2b from escaping from the grooves of the rollers 17 which support them. These means are, for instance, placed on the inner faces of the flanges 66a, 66b of an arch 61 and above the groove of the corresponding rollers 17'a, 17''b. These means may be formed, for instance, of a plate 69 which protrudes inwards and is curved around a vertical axis with its convexity facing the plane P.

Also, the intermediate tower 10 of an installation in accordance with the invention preferably comprises means 70 to recover the cables 2a, 2b should the latter escape the grooves of the corresponding support rollers 17'a, 17''a, 17'b, 17''b. These recovery means 70 are formed, for instance, of a length of gutter open towards the top which is fastened rigidly to the inner face of each inner part 60''a, 60''b in the vicinity of the upstream rollers 17'a, 17'b. These gutters are preferably curved around a horizontal, transverse axis with their convexity facing upward. Their dimension in transverse direction is limited substantially to the width of a cable such as 2a, 2b in order not to prevent the passing of the suspension 7 and of the carriage 4.

Accordingly, there are associated with the upstream rollers 17a, 17b on the one hand the means 69 for preventing the cables 2a, 2b from escaping the grooves of the rollers and, on the other hand, the means 70 for the recovery of the cables 2a, 2b.

Two successive unit rockers 58 are preferably arranged in the same direction, that is to say with the rigidification arches 61 arranged upstream. These two successive unit rockers 58 are mounted articulated for free pivoting around horizontal, transverse pins 71', 71'' at the two free end portions 72', 72'' of two intermediate parts 73a, 73b which are symmetrical with respect to the plane P and articulated for free pivoting around a horizontal, transverse pin 74 to the support rocker 55a, 55b, directly or indirectly. The pin 74 is located in the central portion of the intermediate parts 73a, 73b.

In the preferred embodiment shown in FIG. 7, the tower comprises four successive unit rockers 58 forming an upstream group 75' of two unit rockers 58 and a downstream group 75'' of two other unit rockers 58. All these rockers are arranged in the same direction. The two unit rockers 58 of the upstream group 75' are mounted pivoting on two intermediate parts 73a, 73b articulated to the support rockers 55a, 55b around the pin 74 located at the upstream free end portion 76' of these support rockers 55a, 55b.

The rollers of these two unit rockers 58 of the upstream group 75' follow each other at regular intervals. They are furthermore followed, at the same interval, by rollers of the upstream group 75'' which has the same structure as described previously, which are articulated to the downstream free end portion 76'' of the rockers 55a, 55b. The articulations, in particular of the support rockers 55a, 55b with the yoke 16, of the unit rockers 58 with the support rockers 55a, 55b (by the possible intermediate parts 73a, 73b) which are normally free can possibly be limited in amplitude and/or with a certain braking.

The system which has just been described operates in the following manner:

Between two end stations 9, the clamping clamps 3 are in engaged state since subjected without restrictions to the resilient means 25. The cables 2a, 2b bear and pull the carriage 4 and therefore the vehicle 1. The structural arrangement described is such that the lateral stability of the assembly is improved. When the vehicle 1 arrives above an intermediate tower 10, the comfort rollers 46 roll on the travel tracks 47, which has the effect of moving the cables 2a, 2b of the rollers 17 very slightly apart, on the order of a few millimeters. This arrangement is not present at the end stations 9, where the two ramps 29 are provided. In this way, the vehicle 1 is not affected by jolts upon the passage of these rollers 17. When the vehicle 1 arrives in an end station 9, the disengagement rollers 26 come against the single ramp 29 which is suitably profiled so as to approach the cable path 2a, 2b. It follows that the movable jaws 21 pivot around their articulation pin against the resilient means 25 which has the effect of opening the clamps 3, which are then in disengaged state. At the same time, the carriage 4 comes to rest on stationary support means, such as a U-shaped track 77, due to the support rollers 39. The carriage 4 is guided due to the guide rollers 42. The profile of these stationary support means is such that they make it possible to disengage the clamps 3, which are unclutched, from the cables 2a, 2b. For example, the path of the cables 2a, 2b moves away towards the bottom and the stationary support means approach each other towards the top of the profile of the path of the cables 2a, 2b. The vehicle 1 is braked in its sliding movement by friction bands 48. At the start, the same operations are carried out in the opposite direction, that is to say the stationary support means place the clamps 3 opposite the cables 2a, 2b, the ramp 29 releases the disengagement rollers 26 which permit the closing of the clamps 3 and prior to this the friction bands 48 have made it possible to progressively bring the carriage 4 up to the speed of the cables by acceleration rollers.

Furthermore, the means 69 for preventing the cables 2a, 2b from escaping from the grooves of the rollers and, on the other hand, the means 70 for the recovery of the cables 2a, 2b assure the holding of the cables 2a, 2b at the level of the yokes 16, in particular when the cables 2a, 2b are moved away from the rollers 17 and/or should an unforeseen event occur.

Of course, the invention may be the object of numerous modifications.

I claim:

1. An aerial cable transportation system comprising at least one vehicle including a carriage having a suspension and a plurality of clamping means for disengageably securing the carriage to a pair of endless carrier and traction cables which are parallel to and alongside each other in the horizontal direction, said cables being driven continuously at the same speed and supported by intermediate support and/or compression towers, each of which has a base, a shaft, a horizontal, transverse cross arm, and two series of support and/or compression rollers for the two cables, said clamping means including two pairs of clamps with each of the pairs of clamps being associated with one of the two cables, said two pairs of clamps defining a rigid quadrilateral in the form of a parallelogram which is not a rectangle and which, in the engaged state, favors the synchronous passage of the two cables, said clamps each including a clamp body comprising a generally arch-shaped part mounted on the carriage with its concavity facing downwardly and extending outwardly from the carriage, transversely of the direction of movement thereof, and having an outer end portion defining a stationary jaw for the clamp and an inner end portion, and elastically deformable means for securing said inner end portion of the arch-shaped part to the carriage while permitting a limited play of the arch-shaped part to the carriage on either side of a normal position around a transverse axis, said clamp body being mounted pivotally with respect to the carriage around a horizontal, transverse pin by means of bearings fastened to the carriage, and means mounted on said stationary jaws for extending the stationary jaws in opposite directions along their associated cables, with said extending means of each clamp being spaced from the extending means of the adjacent clamp on the same side of the carriage to provide clearance therebetween.

2. An aerial cable transportation system according to claim 1 wherein each carriage includes support rollers mounted for free pivoting around horizontal, transverse pins and guide rollers mounted for free pivoting around vertical pins for supporting the carriage and guiding it in the transverse direction when the clamps are disengaged.

3. An aerial cable transportation system according to claim 1, wherein the carriage comprises a chassis formed of two axial side rails and two end cross members extending therebetween.

4. An aerial cable transportation system according to claim 1, wherein the two pairs of clamps are located on opposite sides of the carriage and are spaced apart transversely by a minimum distance, taking into account the size of the clamps, said pairs of clamps defining the rigid quadrilateral which is not a rectangle including two central clamps being spaced axially from each other by a distance at least equal to the size of the suspension.

5. An aerial cable transportation system according to claim 1 in which each pair of clamps includes a movable jaw formed on the lower and end portion of an arm located in a transverse plane and articulated to its associated clamp body around an axial pin; resilient means for biasing the movable jaw towards the stationary jaw; and a roller mounted for free pivoting at the inner and upper end portion of the arm around a substantially horizontal, transverse pin for cooperating with an engagement-disengagement ramp forming part of the upstream disengagement and downstream engagement means of an end station, said disengagement rollers being located in the immediate vicinity of the axial vertical plane of symmetry of the carriage to engage a single engagement ramp disposed on each side of each of the end stations.

6. The system as defined in claim 5 wherein said resilient means is a spring positioned substantially vertically in the carriage and engaged between the carriage and an associated arm.

7. An aerial cable transportation system according to claim 1 wherein the most central elastically deformable means of the two outermost clamps are located in the transverse direction between the two outermost elastically deformable members of the neighboring two inner clamps.

8. An aerial cable transportation system according to claim 1 wherein the carriage includes two pairs of comfort rollers freely pivotable around horizontal, transverse shafts for rolling on travel tracks associated with the intermediate support and/or compression towers.

9. An aerial cable transportation system according to claim 8, wherein an intermediate support and/or compression tower has two travel tracks for the comfort rollers following generally the profile of passage of the cables while being very slightly moved away from this profile vertically upward or downward except at its end so that upon passing above a tower the carriage, due to its comfort rollers, rolls on the travel tracks, the cable being very slightly spaced from the rollers.

10. An aerial cable transportation system according to claim 9, wherein an intermediate support and/or compression tower has means for preventing the cables from escaping from the grooves of the corresponding rollers.

11. An aerial cable transportation system according to claim 10, wherein the means for preventing the cables from escaping from the corresponding rollers are formed of an inwardly protruding curved plate which is arranged immediately above the groove of the adjacent rollers with its convexity facing the inside.

12. An aerial cable transportation system according to claim 9 including means for recovering the cables if the latter escape from the grooves of the corresponding rollers, said recovering means being mounted on the support side rails.

13. The system as defined in claim 1 wherein said elastically deformable means include blocks of elastomeric material.

14. The system as defined in claim 1 including means mounted on said stationary jaws for extending the stationary jaws in opposite directions along their associated cables, with said extending means of each clamp being spaced from the extending means of the adjacent clamp on the same side of the carriage to provide clearance therebetween.

15. The system as defined in claim 1, wherein the limited play of the arch-shaped part on either side of a normal position around a transverse axis is on the order of 2°.

16. An aerial cable transportation system comprising at least one vehicle including a carriage having a suspension and a plurality of clamping means for disengageably securing the carriage to a pair of endless carrier and traction cables which are parallel to and alongside each other in the horizontal direction, said cables being driven continuously at the same speed and supported by intermediate support and/or compression towers, each of which has a base, a shaft, a horizontal, transverse cross arm, and two series of support and/or compression rollers for the two cables, said clamping means including two pairs of clamps with each of the pairs of clamps being associated with one of the two cables, said two pairs of clamps defining a rigid quadrilateral in the form of a parallelogram which, in the engaged state, favors the synchronous passage of the two cables, said carriage including a chassis formed of two axial side rails and two end cross members extending therebetween, said carriage including two pairs of comfort rollers mounted on the two end cross members freely pivotable around horizontal, transverse shafts for rolling on travel tracks associated with the intermediate support and/or compression towers, wherein an intermediate support and/or compression tower has two travel tracks for the comfort rollers following generally the profile of passage of the cables while being very slightly moved away from this profile vertically upward or downward except at its end so that upon passing above a tower the carriage, due to its comfort rollers, rolls on the travel tracks, the cable being very slightly spaced from the rollers.

17. An aerial cable transportation system according to claim 16, wherein an intermediate support and/or compression tower has means for preventing the cables from escaping from the grooves of the corresponding rollers.

18. An aerial cable transportation system according to claim 17, wherein the means for preventing the cables from escaping from the corresponding rollers are formed of an inwardly protruding curved plate which is arranged immediately above the groove of the adjacent rollers with its convexity facing the inside.

19. An aerial cable transportation system according to claim 18, wherein said plate is curved, with its convexity facing the inside.

20. An aerial cable transportation system according to claim 18, including means for recovering the cables if the latter escape from the grooves of the corresponding rollers, said recovering means being mounted on the support side rails.

* * * * *